US006968645B2

(12) United States Patent
Epps et al.

(10) Patent No.: US 6,968,645 B2
(45) Date of Patent: Nov. 29, 2005

(54) SLIDING SERVICE WINDOW

(75) Inventors: Jim C. Epps, Houston, TX (US); Jerry Larson, Houston, TX (US); Dan L. Terry, Houston, TX (US); Brian K. Coble, Houston, TX (US)

(73) Assignee: Quikserv Corporation, Houston, TX (US)

( * ) Notice: Subject to any disclaimer, the term of this patent is extended or adjusted under 35 U.S.C. 154(b) by 53 days.

(21) Appl. No.: 10/162,185

(22) Filed: Jun. 3, 2002

(65) Prior Publication Data

US 2002/0148162 A1 Oct. 17, 2002

Related U.S. Application Data

(63) Continuation-in-part of application No. 09/679,019, filed on Oct. 4, 2000, now Pat. No. 6,397,530.

(51) Int. Cl.[7] ..... E05F 17/00; E05D 7/08; E06B 3/00

(52) U.S. Cl. ..... 49/123; 49/116; 52/207

(58) Field of Search ..... 49/121, 116, 119, 49/120, 126, 123, 366, 370, 306, 347, 331–332, 49/354, 356, 357, 122; 52/204.1, 207, 204.6, 52/204.54

(56) References Cited

U.S. PATENT DOCUMENTS

| | | | | | |
|---|---|---|---|---|---|
| 725,581 | A | | 4/1903 | McLaughlin | |
| 874,612 | A | * | 12/1907 | McCandless | 110/178 |
| 1,205,435 | A | | 11/1916 | Cory | |
| 1,245,709 | A | | 11/1917 | Hager | |
| 1,738,792 | A | | 12/1929 | O'Rourke | |
| 1,944,450 | A | * | 1/1934 | Myers | 292/224 |
| 2,057,975 | A | * | 10/1936 | Plym | 49/458 |
| 2,334,981 | A | * | 11/1943 | Ackley | 74/89.22 |
| 2,339,315 | A | | 1/1944 | Alio | 20/19 |
| 2,878,532 | A | | 3/1959 | Clark | 20/19 |
| 2,989,302 | A | | 6/1961 | Clark | 268/30 |
| 3,074,124 | A | | 1/1963 | Bergstedt | 20/19 |
| 3,318,048 | A | | 5/1967 | Odend'hal | 49/223 |
| 3,334,444 | A | | 8/1967 | Hargrove | 49/404 |
| 3,425,160 | A | * | 2/1969 | Petterborg | 49/127 |
| 3,438,147 | A | * | 4/1969 | Lander | 49/7 |
| 3,805,450 | A | | 4/1974 | Forcina | 49/231 |
| 3,993,988 | A | * | 11/1976 | Walter | 340/548 |
| 4,003,102 | A | * | 1/1977 | Hawks et al. | 16/72 |
| 4,250,955 | A | | 2/1981 | Plattner et al. | 165/14 |
| 4,461,160 | A | | 7/1984 | Van Gompel | 70/100 |
| 4,475,313 | A | * | 10/1984 | Governale | 49/370 |
| 4,646,471 | A | | 3/1987 | Shaiu | 49/231 |
| 4,702,037 | A | * | 10/1987 | Hollowell et al. | 49/114 |
| 4,891,911 | A | | 1/1990 | Yung | 49/404 |

(Continued)

OTHER PUBLICATIONS

"Manual Operation & Manual 'Self-Closing' Windows Single Sliders", QUIKSERV®, M.C.E. Systems Corp.

(Continued)

*Primary Examiner*—Jeanette E. Chapman
(74) *Attorney, Agent, or Firm*—Trop, Pruner & Hu, P.C.

(57) ABSTRACT

In accordance with one embodiment of the present invention, a sliding, bi-parting, service window may be operated by pressing on a push operator. In response to such push operation, a pair of bi-parting windows may be caused to slide apart sufficiently to provide a service opening. In some embodiments the windows may automatically close when pressure is released, for example, in response to the action of a weight that moves to a position of higher potential energy in response to opening of the windows.

25 Claims, 4 Drawing Sheets

U.S. PATENT DOCUMENTS

| | | | | | |
|---|---|---|---|---|---|
| 5,050,943 | A | * | 9/1991 | Barnett | 312/319.4 |
| 5,109,910 | A | * | 5/1992 | Tortorella et al. | 160/197 |
| 5,165,142 | A | | 11/1992 | Pilsbury | 16/90 |
| 5,285,596 | A | | 2/1994 | Kinsey | 49/404 |
| 5,365,636 | A | * | 11/1994 | Jensen | 16/67 |
| 5,572,830 | A | | 11/1996 | Freeman | 49/273 |
| 5,659,999 | A | * | 8/1997 | Benson | 49/404 |
| 5,682,710 | A | * | 11/1997 | Davies et al. | 49/162 |
| 5,687,506 | A | * | 11/1997 | Davies et al. | 49/260 |
| 5,850,672 | A | * | 12/1998 | Dalton | 16/81 |
| 5,946,857 | A | * | 9/1999 | Davies et al. | 49/260 |
| 5,970,657 | A | | 10/1999 | Glass | 49/231 |
| 5,996,285 | A | * | 12/1999 | Guillemet et al. | 49/213 |
| 6,065,184 | A | | 5/2000 | Drury | 16/81 |
| 6,360,487 | B1 | * | 3/2002 | Kern et al. | 49/231 |
| 6,397,530 | B1 | | 6/2002 | Terry et al. | 52/204.1 |
| 6,397,539 | B1 | * | 6/2002 | Kimura | 52/302.4 |
| 6,435,254 | B1 | * | 8/2002 | Todd et al. | 160/309 |

OTHER PUBLICATIONS

"Manual Windows Bi-Fold and Single Sliding", QUIK-SERV®, M.C.E. Systems Corp.

"Ready Access Inc. The Leader in Pass-Thru Windows Systems", Ready Access Inc.

* cited by examiner

SLIDING SERVICE WINDOW

CROSS-REFERENCE TO RELATED APPLICATION

This application is a continuation-in-part of U.S. patent application Ser. No. 09/679,019, filed Oct. 4, 2000, issuing as U.S. Pat. No. 6,397,530, on Jun. 4, 2002.

BACKGROUND

This invention relates generally to sliding service windows, for example, that may be used by fast food restaurants.

Sliding service windows are utilized by fast food or drive through restaurants to provide food and receive money from customers. Sliding service windows are also used by other establishments that provide drive-through or walk-up service for their customers. Conventionally, a window is positioned in a building at the level of a car window. The restaurant employee may open the window and hand out food or receive money through the opened window.

Advantageously, the window may self-close, for example, for health reasons. Many sliding service windows are self-closing in that once open, the windows automatically close when-the window is released by the user. Maintaining the window in a normally closed state may have health and environmental advantages.

In the so called bi-parting service window, a pair of sliding windows slide away from one another to create an opening through which service may be provided to a customer. Conventionally, these bi-parting service windows are manually operated by grabbing a handle on the window or electrically operated by motors. However, motors tend to be particularly slow and in some cases may not be completely satisfactory to some customers. In addition, it is somewhat awkward to grab the window itself in order to open the window, particularly when the employee has food items or other products in his or her hands.

In the past, swinging windows have been provided that may be operated by pressing an operator. The employee can press the operator with the employee's hip even when the employee's hands are full. As a result of operation of the push operator, the windows may swing or rotate open. The windows may automatically close when pressure on the operator is released.

While swinging or rotating windows are advantageous in many cases, it is more desirable to have windows which slide open. The outwardly swinging windows may impact a customer or a customer's vehicle. In addition, the swinging windows may be more prone to being broken in operation. In windy conditions the swinging windows may be more difficult to open or close.

Thus, there is a need for better service windows.

DETAILED DESCRIPTION

Figure 1:
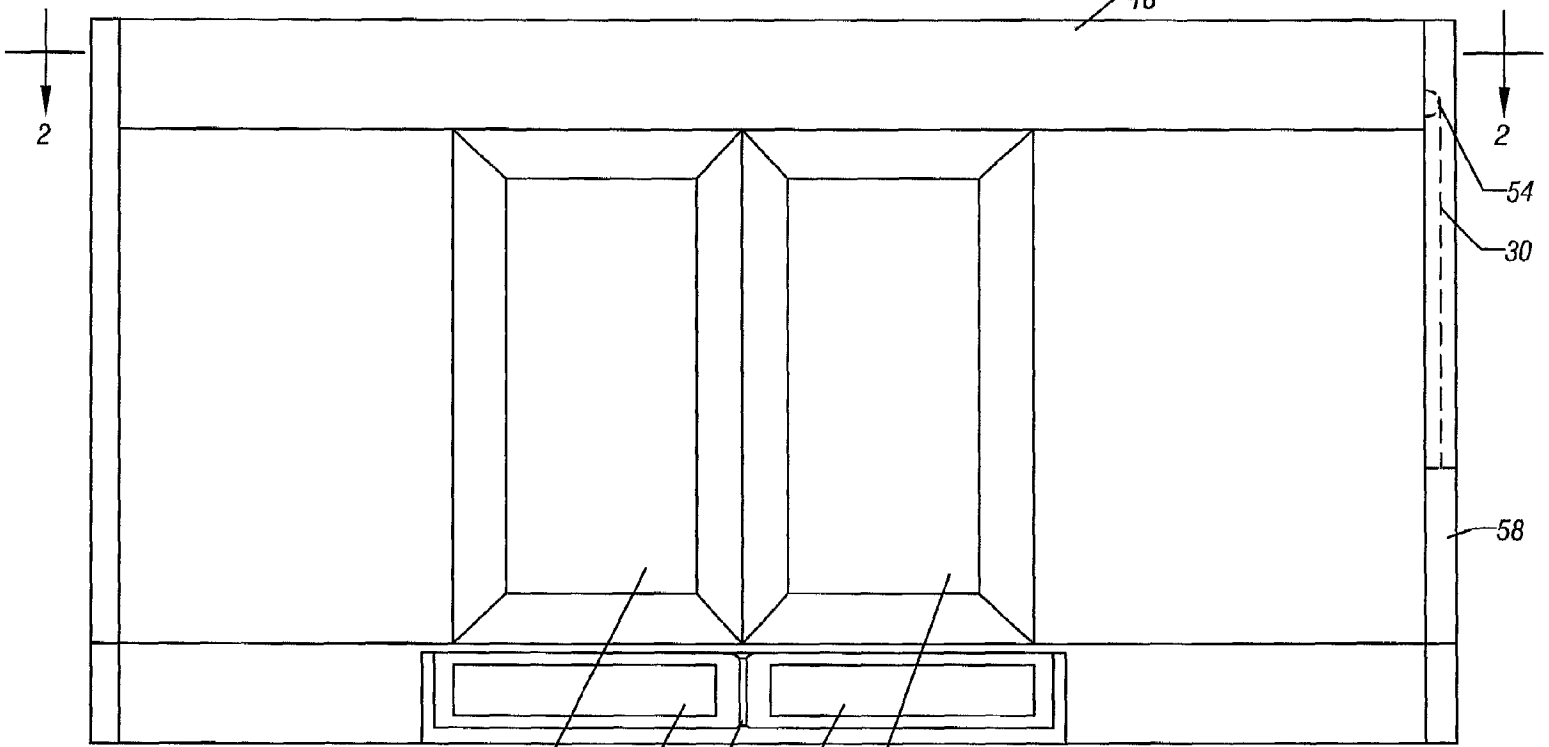
FIG. 1 is a front elevational view of one embodiment of the present invention with the windows closed.

Referring to FIG. 1, a service window 10 may include a pair of sliding windows 12*a* and 12*b* mounted in a frame 18. The frame 18 may be mounted in the side of a building in accordance with one embodiment of the present invention. An employee may open the window 10 to hand out products through the open window or to receive payment.

The window 10 may be opened by pressing the employee's hip against one of the hinged push operators 14*a* and 14*b* located on the interior side of the window 10. The hinged push operators 14*a* and 14*b* may protrude from the frame 18 to a point, indicated at 16, in accordance with one embodiment of the present invention. A hinge may be provided at 16 so that when the user pushes on either operator 14*a* or 14*b*, both operators move inwardly into the frame 18.

The windows 12*a* and 12*b* may be closed after being opened under control of a weight 58 which slides within a track within the frame 18. The weight 58 may be mounted on a wire 30 or other strand or belt. The wire 30 may be redirected by a pulley 54 in one embodiment of the present invention.

Figure 2:
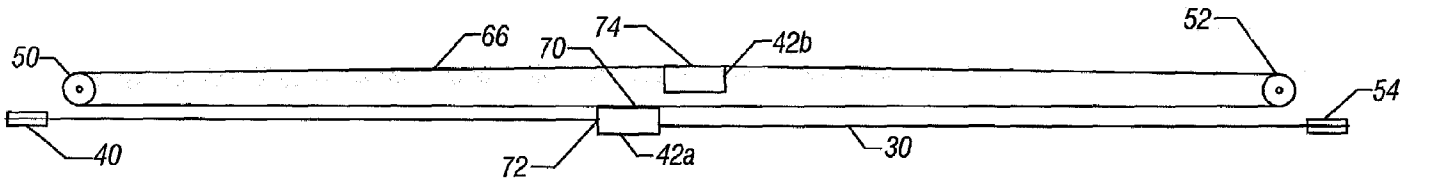
FIG. 2 is a cross-sectional view taken generally along the line 2—2 in FIG. 1.

Referring to FIG. 2, the pulley 54 may redirect the wire 30 to a flange 42*a* coupled to the window 12*a*. The wire 30 may continue over a pulley 40, extending downwardly through the window frame 18 to the underside of the window 10 where it couples to a mechanism (not shown in FIG. 1) that is coupled to the push operators 14. In response to a relatively limited displacement of one of the push operators 14*a* and 14*b*, the wire 30 may be pulled under the window 10 significantly, causing the windows 12*a* and 12*b* to move substantially apart from one another as shown in FIG. 3.

In one embodiment of the present invention, the pulling action is applied directly to one of the windows 12, for example, the window 12*a* through its flange 42*a*. The other window, in this case the window 12*b*, is caused to open through the connection implemented by a wire 66. The wire 66 may also be implemented by a strand or belt, as two examples. The wire 66 extends around a pair of pulleys 50 and 52. Thus, when the window 12*a* moves to the left, for example, under control of the wire 30, the wire 66 pulls the flange 42*b* coupled to the window 12*b*. This pulling force is applied through the wire 66 from the flange 42*a* around the pulley 52. As a result, the flange 42*b* and, thus, the window 12*b*, is pulled to the right. This causes the windows 12*a* and 12*b* to open or bi-part by moving away from one another in a sliding motion.

Figures 3, 4:
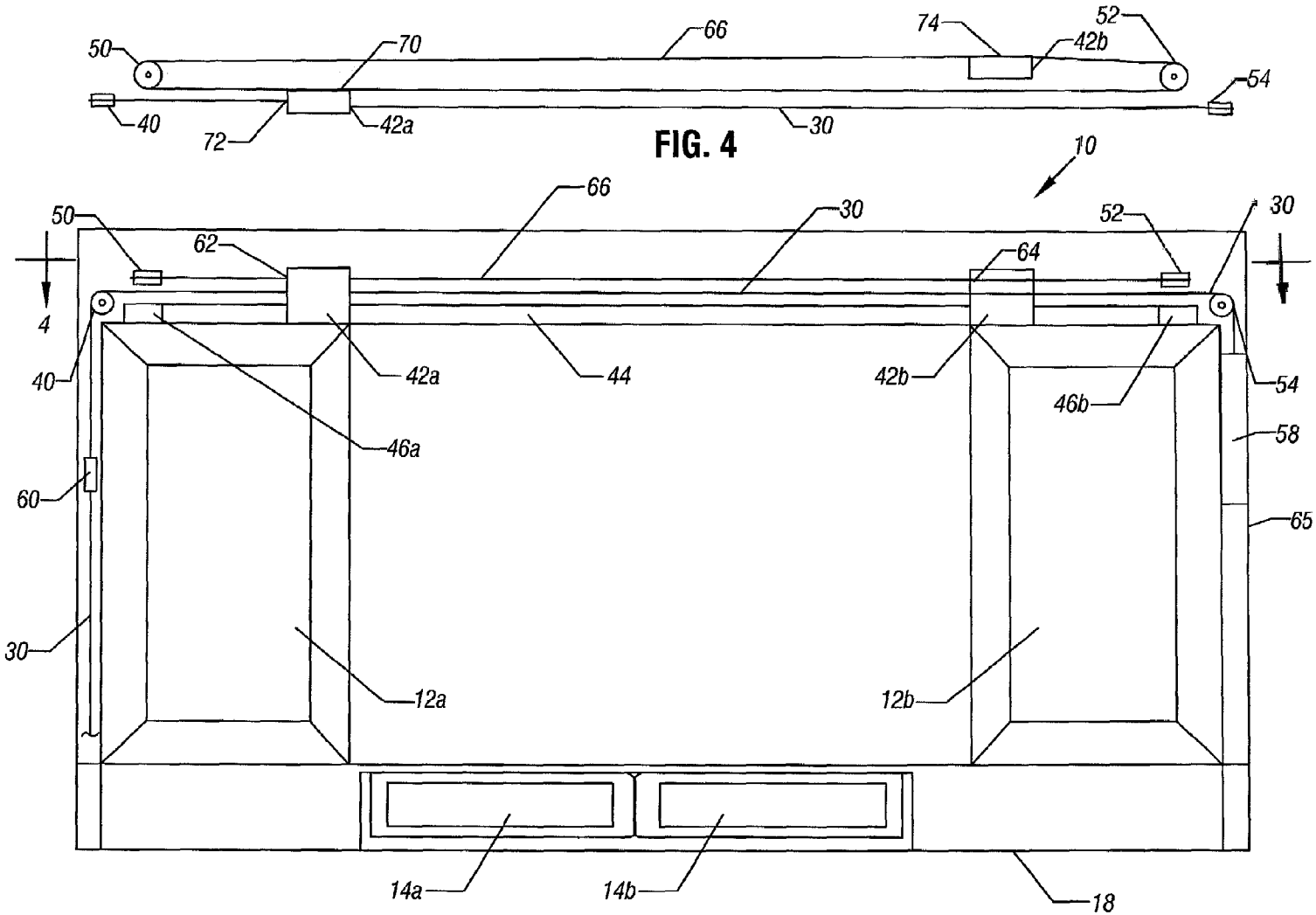
FIG. 3 is a partially cutaway, front elevational view corresponding to FIG. 1 but with the bi-parting windows in the open position in accordance with one embodiment of the present invention.
FIG. 4 is a cross-sectional view taken generally along the line 4—4 in FIG. 3.

Referring to FIG. 3, the windows 12*a* and 12*b* are shown in an open position. This corresponds to the situation that occurs when one or both push operators 14*a* and 14*b* is pressed inwardly and held in the inward position in accordance with one embodiment of the present invention. As a result, the weight 58 is pulled upwardly within its track 65 inside the frame 18. At the same time, the wire 30 is pulled downwardly on the opposite side of the frame 18 closer to the window 12*a*. A substantial length of the wire 30 may be pulled into the area below the window 10 in one embodiment. This pulling action is transferred through the pulley 40 to the flange 42*a*, sliding the window 12*a* to the open position. The motion of opening the window 12*a* is simultaneously applied to the window 12*b* through the wire 66, which motion is redirected by the pulley 52. At the same time, the wire 66 is provided with slack by the pulley 50 to allow the rightward opening movement of the window 12*b*.

Each window 12*a* and 12*b* may be mounted on an upper track 44 for sliding movement in a bi-parting fashion in one embodiment. A lower track may also be used if desired. In one embodiment, each window 12 may include a track 44 engaging member (not shown) coupled to the flanges 42 and to the flanges 46. The track 44 may be engaged by rolling elements, such as rollers or bearings, for example.

Thus, as shown in FIG. 4, as the flange 42*a* is pulled to the left by the pulling motion applied to the wire 30, the window 12*a* slides open causing the window 12*b* to simultaneously slide open through the tension applied to the wire 66. This causes the weight 58 to move upwardly within its track 65 inside the frame 18. As a result, when the pressure is released from an operator 14*a* or 14*b*, the action of the weight 58 substantially assists in automtically closing the windows 12 to the position shown in FIG. 1 in one embodiment.

Figure 5:
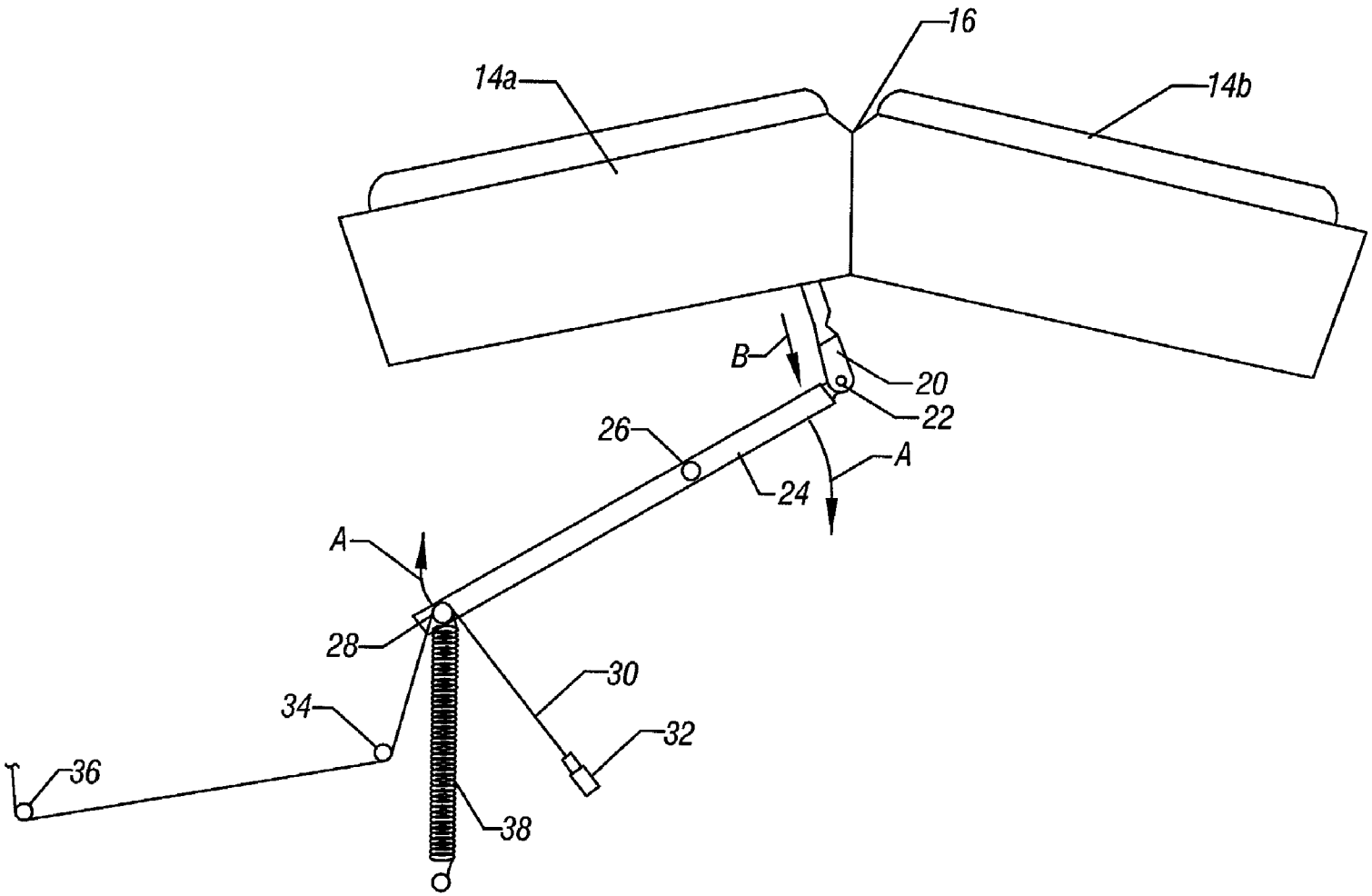
FIG. 5 is a cross-sectional view taken generally along the line 5—5 in FIG. 1 in accordance with one embodiment of the present invention.

In accordance with one embodiment of the present invention, the motion applied through the operators 14*a* and 14*b* may be significantly multiplied. That is, a relatively limited displacement applied by the employee to an operator 14*a* or 14*b* may result in a significant displacement of the wire 30. One mechanism for applying such a multiplying effect is shown in FIG. 5 and includes a link 20 coupled to the operator 14*a*. The link 20 is pivotally connected through a pivot pin 22 to a link 24. The link 24 is mounted to the window 10 for pivoting motion around a pivot 26.

Thus, in response to inward motion indicated by the arrow B applied by the operators 14 to link 20 and then to the link 24, the link 24 rotates as indicated by the arrows A around the pivot 26. This causes the roller 28, mounted on the free end of the link 24, to move in the direct of the proximate arrow A. Namely, the roller 28 moves upwardly pulling upwardly on the wire 30. The wire 30 may be anchored at 32 and may extend around the roller 28 and the pulley 34. Finally, the wire 30 may extend through the pulley 36 and pass upwardly through the frame 18 to the pulley 40. The upward motion on the roller 28 causes the wire 30 to be folded, pulling more of the length of wire 30 across the pulley 36 and opening the window 12*a*.

Figure 6:
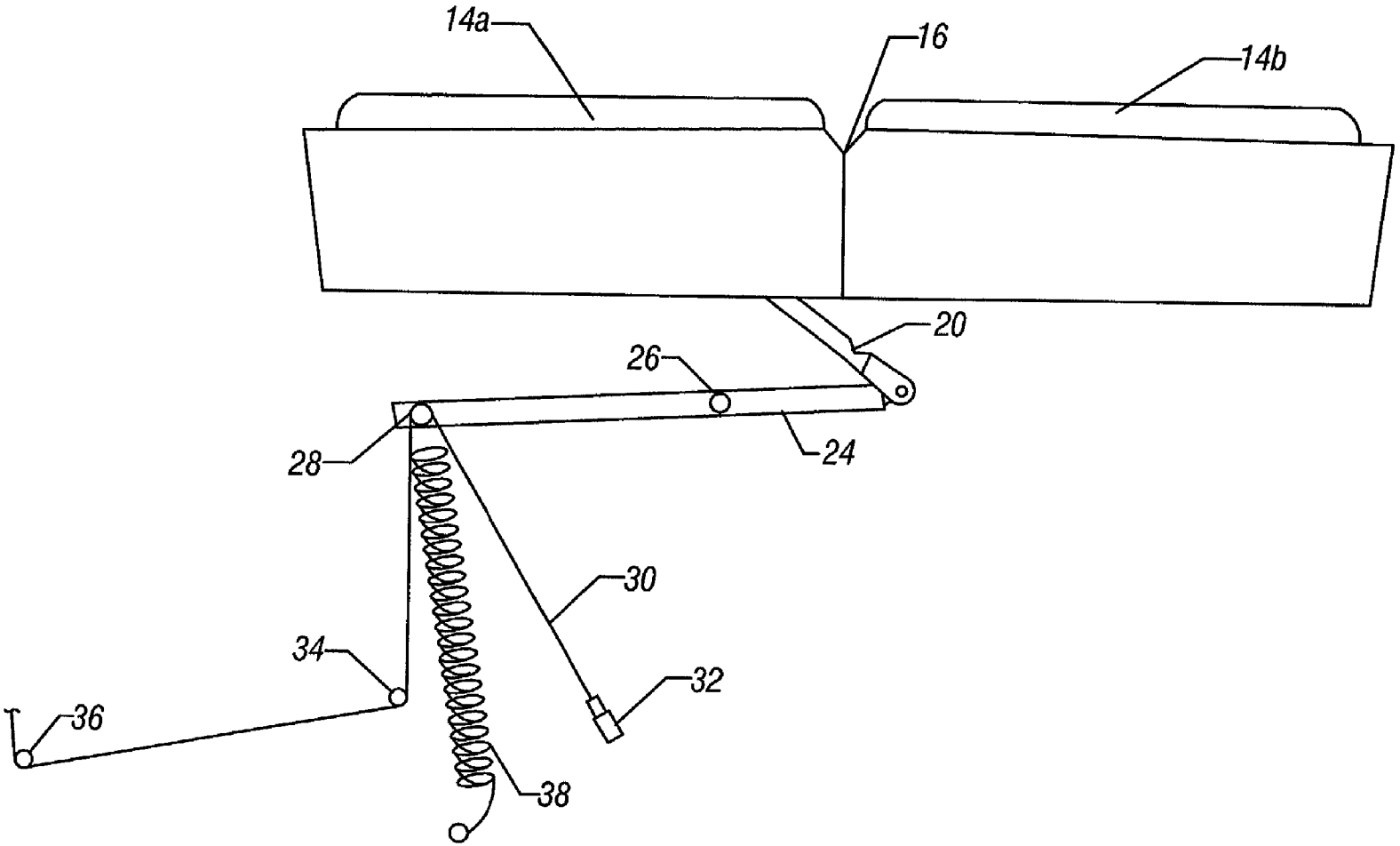
FIG. 6 is a cross-sectional view taken generally along the line 6—6 in FIG. 3 in accordance with one embodiment of the present invention.

Thus, referring to FIG. 6, eventually the wire 30 is significantly taken up between the anchor 32 and the pulley 34. As a result, a small extent of pushing displacement applied to the operators 14*a* and 14*b*, indicated as a difference in positions between FIG. 5 and FIG. 6, results in a much greater length of the wire 30 being taken up between the anchor 32 and the pulley 34. The wire 30 taken up is increased relative to the displacement applied to an operator 14 because of the position of the pivot 26, the action of the links 20 and 24, and the doubling effect of the wire 30 being folded about the roller 28 in some embodiments. Thus, in some embodiments, a displacement of an inch or two may result in several inches of the wire 30 being taken up between the anchor 32 and pulley 34, resulting in a significant sliding displacement of the coupled window 12*a*. For example, a displacement of two inches, as indicated at B, may result in eight inches of wire 30 being taken up in one embodiment of the present invention.

In one embodiment of the present invention, the mechanism for transforming a relatively small pushing operation on an operator 14 into a relatively significant taking up of the wire 30 may be implemented by the mechanisms shown in FIGS. 5 and 6, which mechanisms may be positioned underneath the windows 12 in the region behind the operators 14*a* and 14*b*. However, in other embodiments of the present invention, those mechanisms may be replaced by any suitable mechanism for providing sufficient window opening. All that is desired is that a relatively small pushing action result in significant sliding motion of two windows.

Those skilled in the art will appreciate that it is significant that such a small displacement can result in the extended displacement of not one, but two windows. This is achieved by the multiplying effect of the pushing mechanism and further by the way in which the two windows are linked together. Namely, instead of requiring that both windows be moved independently, in one embodiment all that is needed is enough displacement to move one window, the movement of the one window, through the action of the wire 66, displaces the other window similarly.

Moreover, through the action of the wire 30 with the weight 58, the windows 12 may be automatically closed when the operator 14 is released. Namely, the operation of opening the windows 12 displaces the weight 58 to increase its potential energy. Thus, when the operator 14 is released, the weight 58 automatically closes the windows 12.

Thus, in some embodiments of the present invention, a short push on a push operator 14 results in a more significant sliding movement of one window 12. That same sliding movement is then transformed into two other displacements in some embodiments. The first of those displacements is the opposed sliding motion of the second window 12*b*. The second motion is the displacement of the weight 58 to a position of higher potential energy. This position of higher potential energy serves to assist in closing the windows 12. That action of the weight 58 may be further assisted in some embodiments by the action of the coil spring 38 that is also simultaneously displaced in the course of the same motion just described.

However, the present invention is not limited to any specific technique of self-closing. For example, instead of using the weight system, which is believed to be advantageous, in some embodiments, an inclined track may be utilized. Namely, the windows 12 may be slid along an inclined track to the open position. Then when the operator 14 is released, the windows slide back down the inclined track to the closed position.

Similarly, the present invention is not limited to the particular mechanisms shown in FIGS. 5 and 6. Any mechanism which provides sufficient displacement in response to a relatively small actuating force may be sufficient in some embodiments. Moreover, while the mechanisms are shown in one position in FIGS. 5 and 6, they may be positioned at any suitable location. In some embodiments, the operators 14 may be positioned on a tray which may be slid out to facilitate repair. Thus, the operators 14 may face downwardly away from the windows 12 or may be mounted on a tray and face upwardly to facilitate repair.

Finally, while a mechanism is illustrated in which two windows are opened in a bi-parting operation, those skilled in the art will appreciate that the same principles may be applied to cause any number of windows to-be simultaneously opened. For example, instead of providing a single loop of wire around the pulley 28, a plurality of loops of wire 30 may be provided to more greatly multiply the limited displacement applied to the operator 14 and increase the displacement of the wire 30.

While a wire 30 and a wire 66 are referred to herein, any type of linkage may be utilized in other embodiments of the present invention. Thus, the linkages may be flexible strands such as a wire 30, or a belt, or they may be physical linkages that are rigid in other embodiments. Similarly, a chain may be utilized to link the mechanisms in still another embodiment.

In order to assist in the return from the window open position of FIG. 6 to the window closed position shown in FIG. 5, the spring 38 may be automatically stretched in the course of the window opening displacement of the roller 28. For example, the spring 38 may be stretched between the free end of the link 24 and a mounting point on the window 10. Thus, when the operators 14*a* and 14*b* are pressed inwardly, the spring 38 is stretched. As a result, when the depression on the operators 14 is released, the spring attempts to pull the link 24 downwardly, returning the link 24 to the position shown in FIG. 5. This motion is also supplemented by the action of the weight 58 which also tends to return the windows 12 to their closed positions.

In some embodiments, a weight 60 may be secured to the wire 30. In some cases, an employee may simply grab a window 12 and slide it open. This may result in the collection of an excess length of the wire 30, which excess length can be taken up by the weight 60 pulling the wire 30 downwardly into the frame 18. Any extra length of wire 30 may be collected underneath the window 10 in association with the link 24 or otherwise.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

providing a sliding service window with a pair of biparting, sliding windows; and providing a first linkage linking a push operator one of said windows so that said windows are pulled open automatically without motorized assistance by sliding away from one another in response to operation of the push operator; and moving a weight to a position of higher potential energy in response to the opening of said windows.

2. The method of claim 1 including automatically closing said windows using said weight.

3. The method of claim 2 including automatically closing said windows when said push operator is no longer operated.

4. The method of claim 1 including linking a second window to said one window and automatically sliding said second window open in response to the opening movement of said first window.

5. The method of claim 4 including linking said first and second windows through a linkage.

6. The method of claim 5 including linking said first and second windows through a flexible strand.

7. The method of claim 1 including enabling an operation of a push operator of a first extent to result in a greater extent of sliding motion of at least one of said windows.

8. The method of claim 7 including providing, in response to operation of a push operator, a displacement of at least one window that is at least twice the extent of the operation applied to said push operator.

9. The method of claim 1 including using gravity to close said window.

10. The method of claim 9 including using a weight which moves upwardly and downwardly within the service window to automatically close said window after being open.

11. A service window comprising:

a frame;

a first and a second window element mounted for sliding movement in said frame;

a mechanical operator; and a first linkage including a wire coupling said operator to said first window element to slide said first window element away from said second window element, wherein said mechanical operator enables said elements to automatically open without motorized assistance by sliding away from one another in response to a push operation.

12. The window of claim 11 including a pair of hinged push operators on said frame.

13. The window of claim 11 including a second linkage coupling said first and second window elements, said second linkage causing the second window element to move away from said first window element.

14. The window of claim 13 wherein said second linkage is a wire.

15. The window of claim 14 including a pair of pulleys and said wire is arranged in a loop about said pulleys.

16. The window of claim 11 wherein said window elements automatically close.

17. The window of claim 16 wherein said window elements automatically close in response to the action of gravity.

18. The window of claim 17 including a weight coupled to said window elements, said weight acting to close said window elements when said window is open.

19. The window of claim 18 wherein said weight moves up and down within said frame.

20. The window of claim 19 wherein said weight is raised to a higher position when said window is open.

21. The window of claim 19 wherein said weight is coupled by a wire to at least one of said window elements.

22. The method of claim 1 where enabling said windows to automatically open including enabling said windows to open by the application of a force whose magnitude is less than the amount of force needed to direct open the windows.

23. The window of claim 11 wherein said mechanical operator enable said elements to automatically open in response to less then the amount of force needed to physically directly push the windows apart.

24. The method of claim 1 including enabling said windows to be open without direct user contact.

25. The window of claim 11 said operator to enable said windows to be opened without direct user contact.

* * * * *